US006276557B1

(12) United States Patent
Wysocki

(10) Patent No.: US 6,276,557 B1
(45) Date of Patent: Aug. 21, 2001

(54) WASTE CONTAINER WITH REINFORCED BOTTOM

(75) Inventor: Edward H. Wysocki, Kentwood, MI (US)

(73) Assignee: Cascade Engineering, Inc., Grand Rapids, MI (US)

( * ) Notice: Subject to any disclaimer, the term of this patent is extended or adjusted under 35 U.S.C. 154(b) by 0 days.

(21) Appl. No.: 09/543,471

(22) Filed: Apr. 5, 2000

Related U.S. Application Data

(60) Provisional application No. 60/128,355, filed on Apr. 8, 1999.

(51) Int. Cl.[7] ..... B65D 90/00
(52) U.S. Cl. ..... 220/608; 220/908
(58) Field of Search ..... 220/608, 908, 220/669, 670

(56) References Cited

U.S. PATENT DOCUMENTS

| | | | | |
|---|---|---|---|---|
| 3,563,445 | | 2/1971 | Clayton . | |
| 4,197,958 | | 4/1980 | Zeni et al. . | |
| 4,600,113 | * | 7/1986 | De Mars | 220/908 X |
| 4,749,101 | * | 6/1988 | Durkan, Jr. | 220/908 X |
| 5,036,999 | | 8/1991 | Bitsch . | |
| 5,152,420 | | 10/1992 | Bird et al. . | |
| 5,183,180 | | 2/1993 | Hawkins et al. . | |
| 5,332,115 | | 7/1994 | Schafer . | |
| 5,423,453 | | 6/1995 | Fritz . | |
| 5,582,322 | * | 12/1996 | Prout et al. | 220/908 X |
| 5,685,452 | | 11/1997 | Kristoffersson . | |
| 5,816,591 | * | 10/1998 | Parker et al. | 220/908 X |
| 5,865,338 | | 2/1999 | Conn . | |

* cited by examiner

*Primary Examiner*—Steven Pollard
(74) *Attorney, Agent, or Firm*—Rader, Fishman, Grauer & McGarry, an Office of Rader Fishman & Grauer PLLC

(57) ABSTRACT

The invention relates to a waste container of the type typically used in residential waste collection systems. The waste container includes a container body having opposing side walls that extend upwardly from a bottom wall to form a waste compartment with an open top for access thereto. The bottom wall of the container body is reinforced by a series of corrugations to increase the rigidity of the bottom wall to prevent sagging, which can result in premature wear and failure. The corrugations also increase the heat transfer rate of the bottom wall, which improves the cooling characteristics of the waste container during molding. The corrugations further provide airflow channels for the injection of air between the container body and a mold during the molding process to improve the ease of removing the waste container body from the mold and to prevent stretching in the bottom of the container during the molding process.

28 Claims, 7 Drawing Sheets

WASTE CONTAINER WITH REINFORCED BOTTOM

RELATED APPLICATIONS

This application claims the benefit of U.S. Provisional Application No. 60/128,355, filed Apr. 8, 1999.

BACKGROUND OF THE INVENTION

1. Field of the Invention

The invention relates to a waste container, and, more specifically, to a waste container having a reinforced bottom.

2. Related Art

Current residential waste containers comprise a container body having an open top and a closed bottom. A handle is typically located near the open top and a wheel assembly is typically located near the bottom of the container body. The top is closed by one or more lids, which are hingedly connected to the body or a divider in the body. Most residential waste containers have a relatively large capacity of 30 gallons or more. It is also common for the waste container to be injection-molded out of a suitable plastic.

A common problem for this type of waste container is that the weight of the contents held by the container body can bow the waste container bottom downwardly a sufficient amount so that it contacts the ground, resulting in increased wear and tear on the container body bottom as the waste container is moved about during its lifetime. Ultimately, the excess wear and tear on the container body bottom results in a premature failure of the container. Although this problem can be reduced by increasing the thickness of the bottom wall, this solution increases the cost of the container due to increased material costs and increased cycle time and may also result in undesirable stresses in the container body due to differential cooling during the molding process.

An additional problem arises from the current container bodies having a relatively narrow draft in order to obtain the greatest amount of volume in the smallest plan form. The narrow draft often makes it difficult to remove the container body from the injection mold because of the tendency for a vacuum to form between the container bottom and the mold. To aid in the removal of the container body, air is injected between the mold and the container bottom. The injected air has a tendency to extend the container bottom upwardly into the container body cavity. Since the container body is still relatively warm during removal, the force of the injected air can cause a permanent stretching or arching of the bottom, which exacerbates the tendency of the bottom to contact the ground when the container body is loaded with waste and the bottom inverts from the load.

SUMMARY OF THE INVENTION

The invention relates to a waste container for the storage and collection of residential or commercial waste, comprising an open top body closeable by a cover pivotally mounted to the body, a wheel assembly provided near the bottom of the body and a handle extending from the body. The body has a bottom wall with a peripheral edge and a peripheral wall extending upwardly from the bottom wall peripheral edge and terminating in an upper edge to define a waste compartment with an open top. An inner rib projects downwardly from a bottom surface of the bottom wall and a plurality of corrugations are formed in the bottom wall and extend from the bottom wall peripheral edge to the inner rib wherein the corrugations and inner rib cooperate to form a structural support for the bottom wall.

Preferably, the corrugations comprise elongated indentations, which have a thickness substantially the same as the bottom wall thickness. Each of the elongated indentations preferably define a longitudinal axis and have a U-shaped cross section transverse to the longitudinal axis. When arranged in groups, the combined U-shaped cross sections of the elongated indentations form a truncated sinusoidal-like wave form.

Some of the elongated indentations can extend past the rear edge of the bottom wall and at least partially up the peripheral wall.

The inner rib can circumscribe an interior portion of the lower surface of the bottom wall. The bottom wall peripheral edge is substantially rectangular and defines a front edge, a rear edge, and side edges connecting the front and rear edges to form corners at the junctions of the front and rear edges with the side edges, with corner indentations having an elongated arcuate profile positioned in the bottom wall near the corners and extending between adjacent groups of elongated indentations.

The body can include an outer peripheral rib projecting downwardly from the peripheral edge of the bottom wall along at least a portion of the bottom wall peripheral edge and at least some of the groups of elongated indentations extending between the outer rib and the inner rib.

The wheel assembly preferably comprises an axle mounted to the body and a pair of wheels mounted to the axle, with at least the axle being rotatable relative to the body or the wheels being rotatable relative to the axle.

The invention also relates to a waste container for the storage of waste, comprising a body having a bottom wall with a peripheral edge and a peripheral wall extending upwardly from the bottom wall peripheral edge and terminating in an upper edge to define a waste compartment with an open top. An inner rib projects downwardly from a bottom surface of the bottom wall and a plurality of corrugations are formed in the bottom wall and extend from the bottom wall peripheral edge to the inner rib wherein the corrugations and inner rib cooperate to form a structural for the bottom wall.

DETAILED DESCRIPTION

Figure 1:
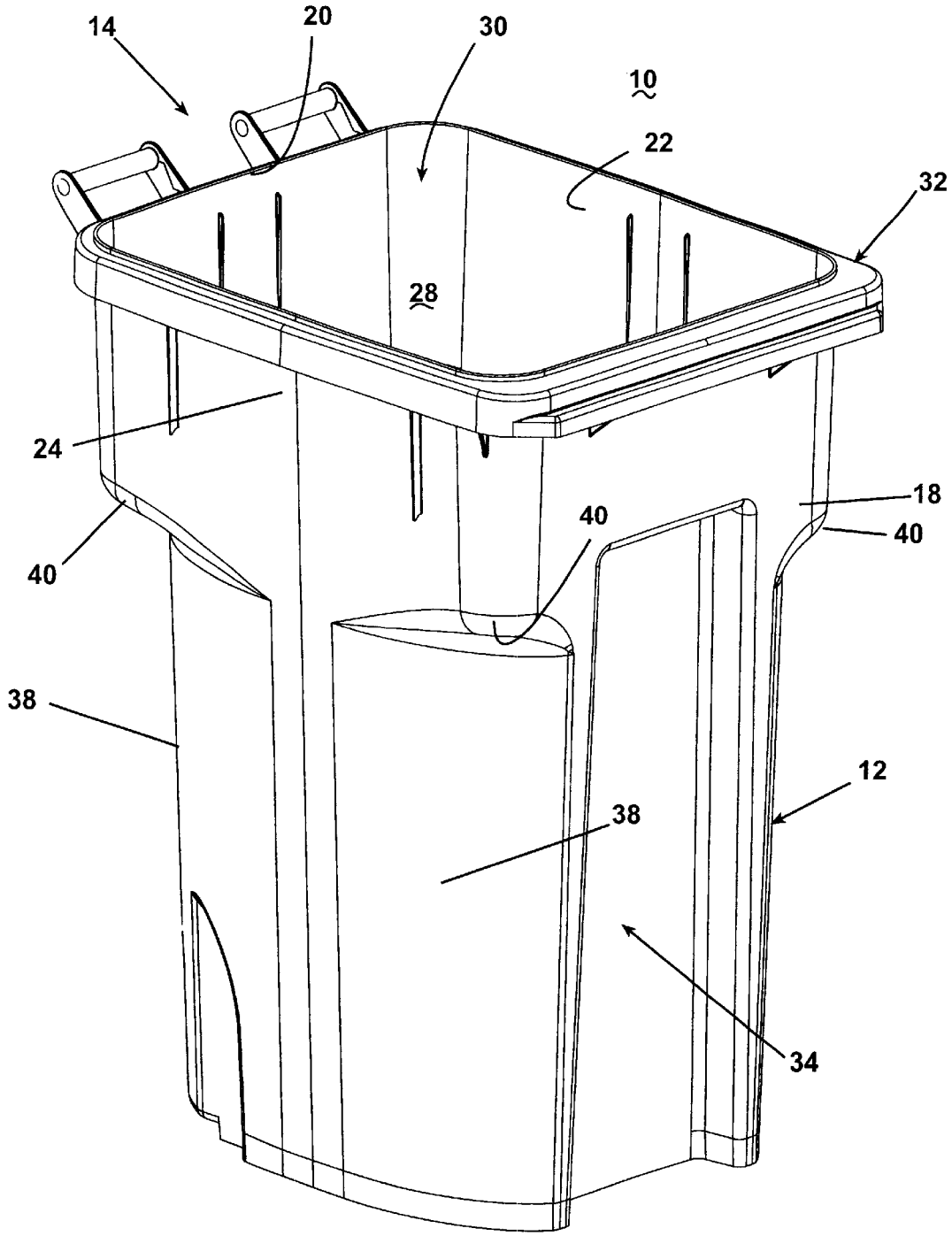
FIG. 1 is a left-front upper perspective view of a waste container with an open-top body having reinforced bottom according to the invention and a cover for closing the open top of the body and a wheel assembly.
Figure 2:
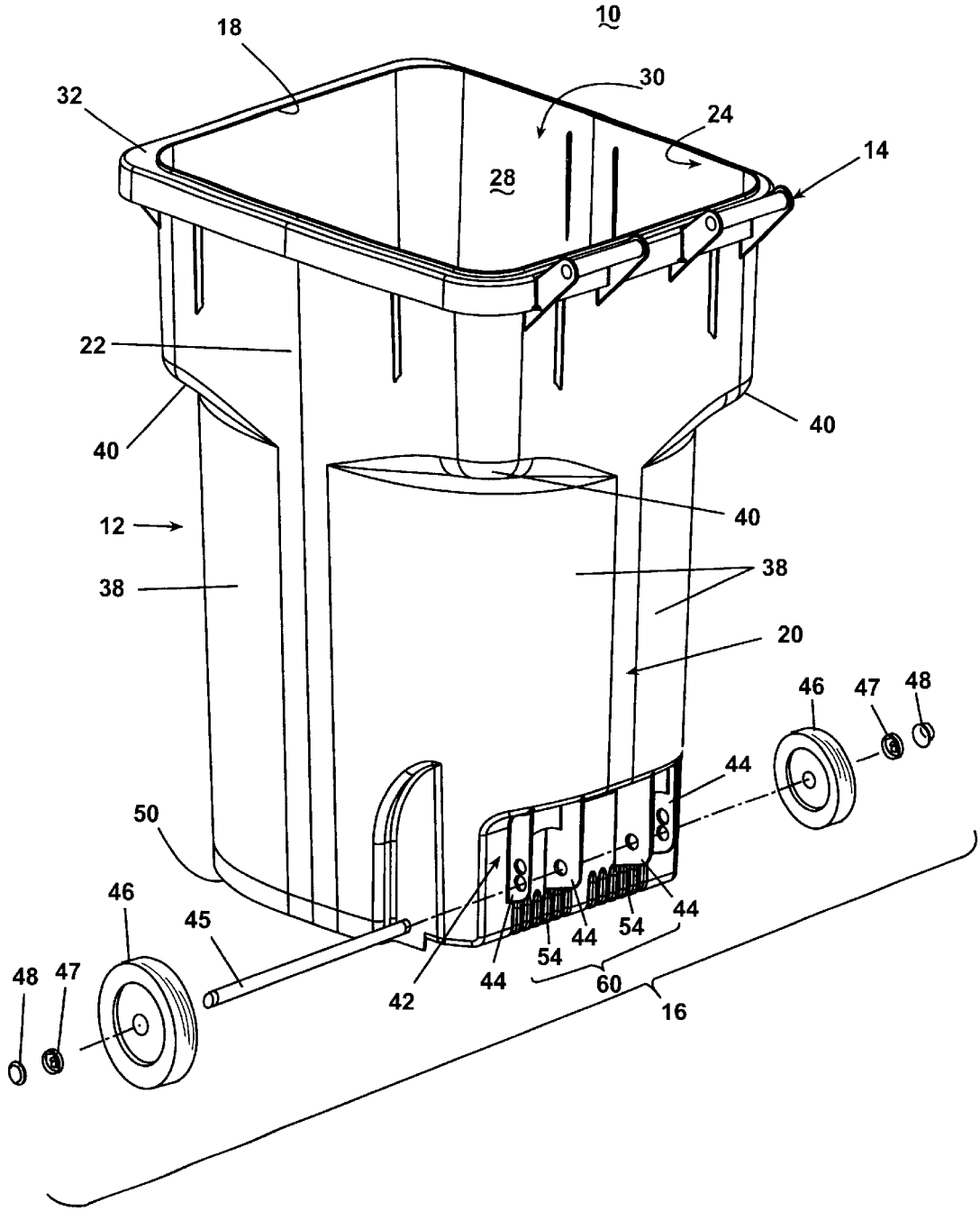
FIG. 2 is a right-rear upper perspective view of the waste container of FIG. 1 with the cover removed and the wheel assembly shown in exploded.
Figure 3:
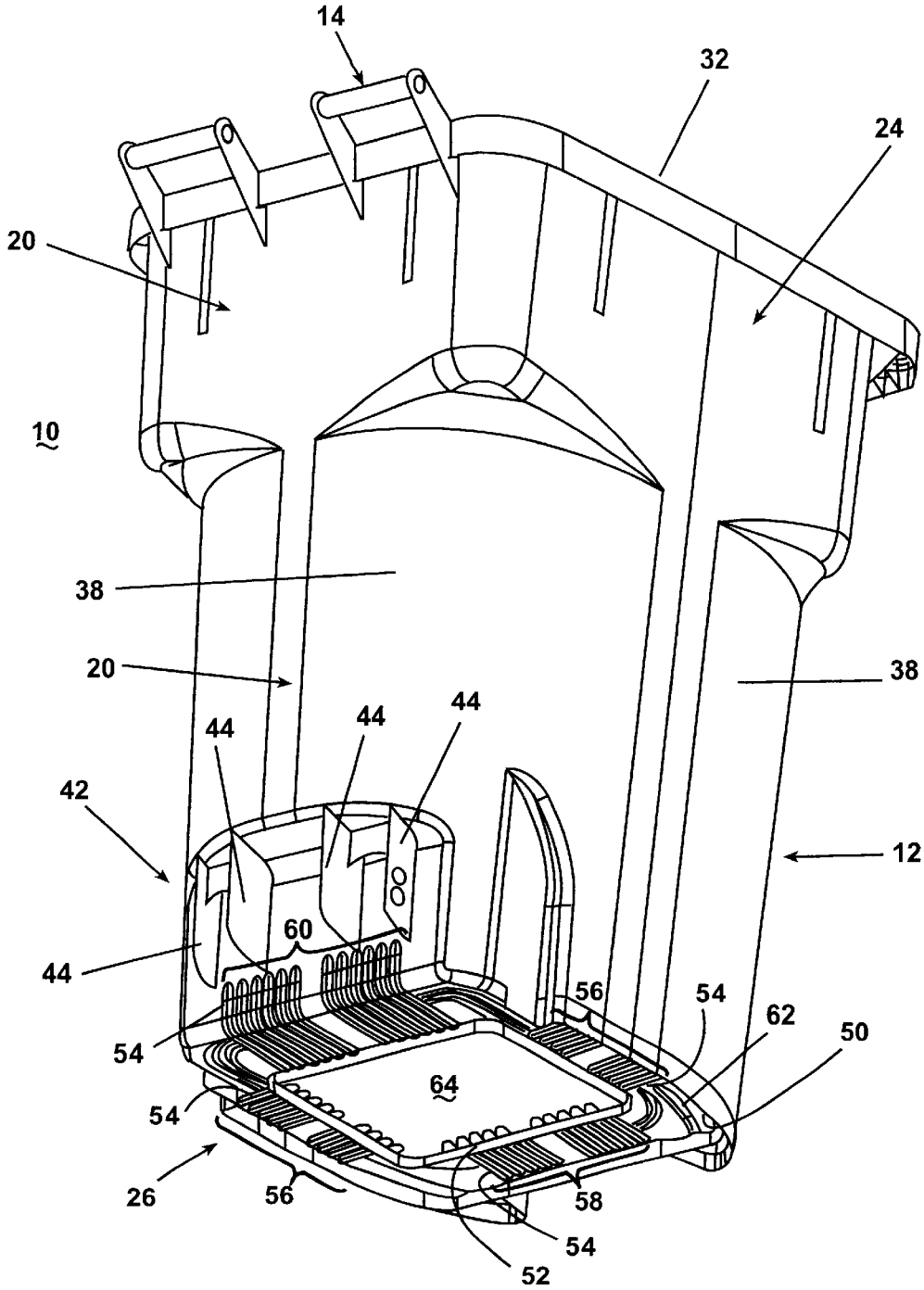
FIG. 3 is a left rear lower perspective view of the waste container of FIG. 1 illustrating the corrugations in the waste container bottom with the cover and wheel assembly removed.

FIGS. 1–3 illustrate a waste container 10 according to the invention. The waste container 10 comprises a waste container body 12 from which extends a handle assembly 14 to which is pivotally mounted a cover 15. A wheel assembly 16 is mounted to a rear lower portion of the body.

The waste container body 12 comprises a peripheral wall that is defined by a front wall 18, a rear wall 20, and side walls 22, 24, which extend upwardly from a bottom wall 26 to define a waste compartment 28 to which access is provided through an open top 30. The open top 30 is bounded by a peripheral lip 32.

The front wall 18 can be provided with an alcove 34 or similar structure, which is often used to aid in the lifting of the container into a collection vehicle. Similarly, the intersections of the front, rear, and side walls are rounded 38 to define a series of shoulders 40. The rounded side walls 38 and the shoulders 40 combine to form a lifting surface for a mechanical lifting device. The peripheral lip 32 can also be used as a lifting surface.

The rear wall 20 includes an alcove 42 located near the intersection of the rear wall with the bottom wall 26. A series of mounting webs 44 are formed in the alcove 42 of the rear wall 20 to permit the mounting of the wheel assembly 16, which includes an axle 45 received in openings in the webs 44, with wheels 46 mounted to the shaft by a fastener 47, which is enclosed by a cover 48. Such a wheel assembly is disclosed in U.S. Pat. No. 5,716,107, which is incorporated by reference.

Figure 4:
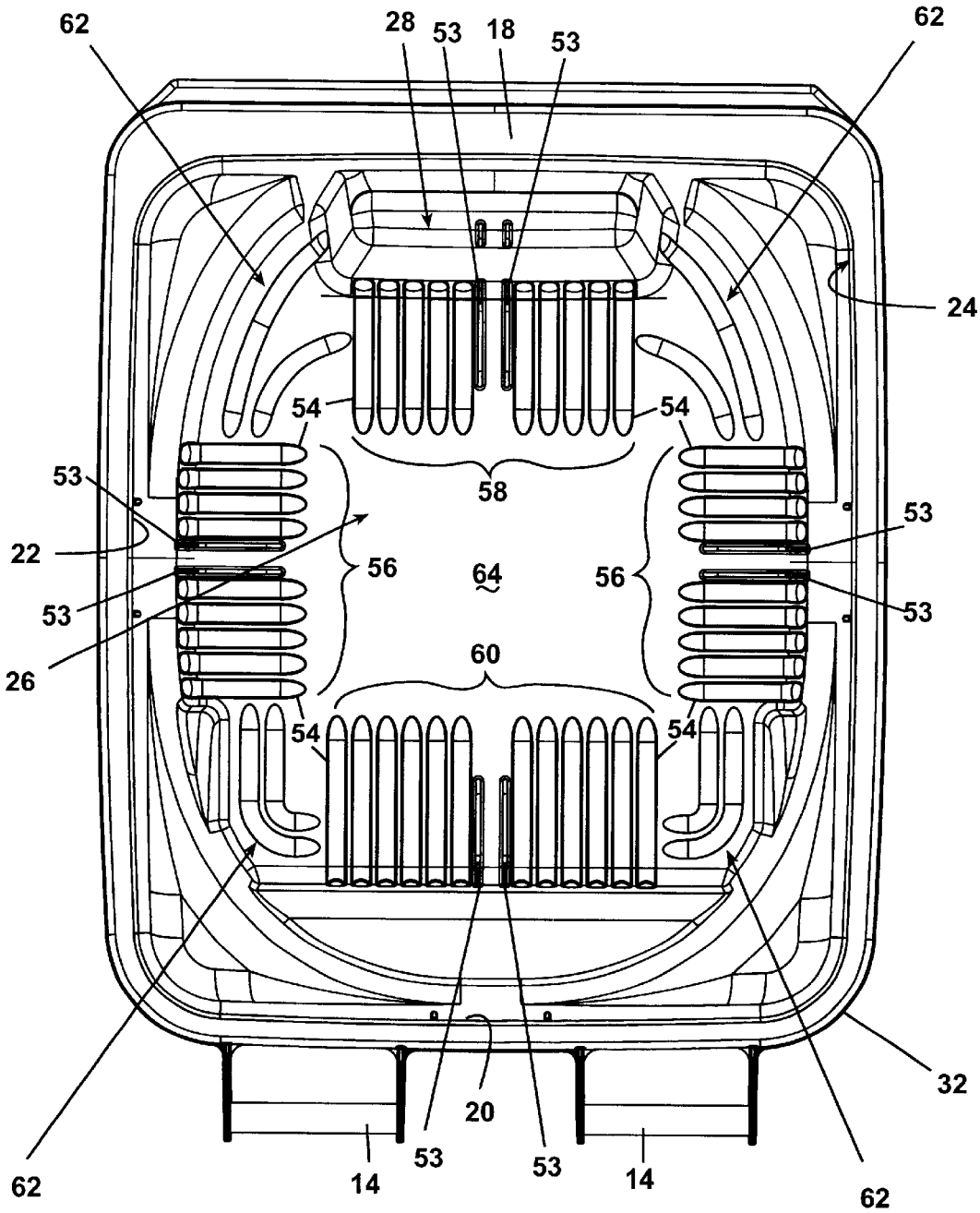
FIG. 4 is a top view of the waste container of FIG. 1 illustrating the bottom wall corrugations.
Figure 5:
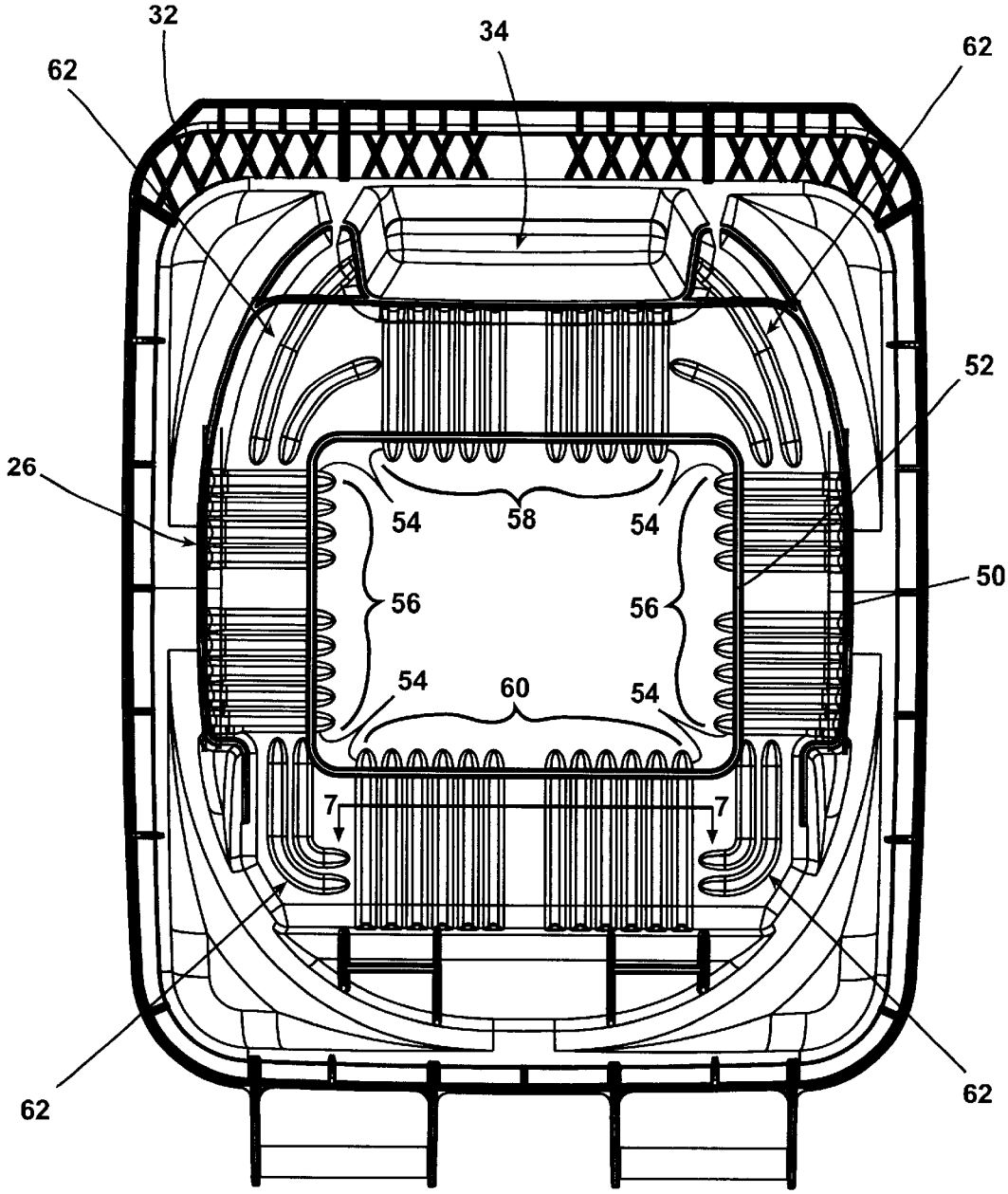
FIG. 5 is a bottom view of the waste container of FIG. 1 illustrating the bottom wall corrugations.

Referring to FIGS. 3–5, the bottom wall 26 has an outer peripheral wear rib 50 that extends along the side walls 22, 24 and across the front wall 18. An inner wear rib 52 extends from the lower surface of the bottom wall 26 and defines a central support area 64. Preferably, the inner wear rib 52 has a generally rectangular shape, but it could also define other geometric enclosed shapes (circle triangle, hexagon, etc.) and non-enclosed shapes.

A series of corrugations 54 are formed in the bottom wall to provide it with increased rigidity. For description purposes, the corrugations 54 can be divided into sets or groups based on their location: side wall corrugations 56, front wall corrugations 58, rear wall corrugations 60, and corner corrugations 62. The side wall corrugations 56 and front wall corrugations 58 all extend from the outer wear rib 50 to just past the inner wear rib 52. The rear wall corrugations 60 extend from the inner wear rib 52, around the junction of the rear wall 20, and the bottom wall 26, and partially up the rear wall 20 within the alcove 42. The corner corrugations 62 effectively connect the adjacent sets of side wall corrugations 56, front wall corrugation 58, and the rear wall corrugation 60. L-shaped side support ribs 53 are arranged in pairs and extend from the front, rear and side walls to the bottom wall.

Figure 6:
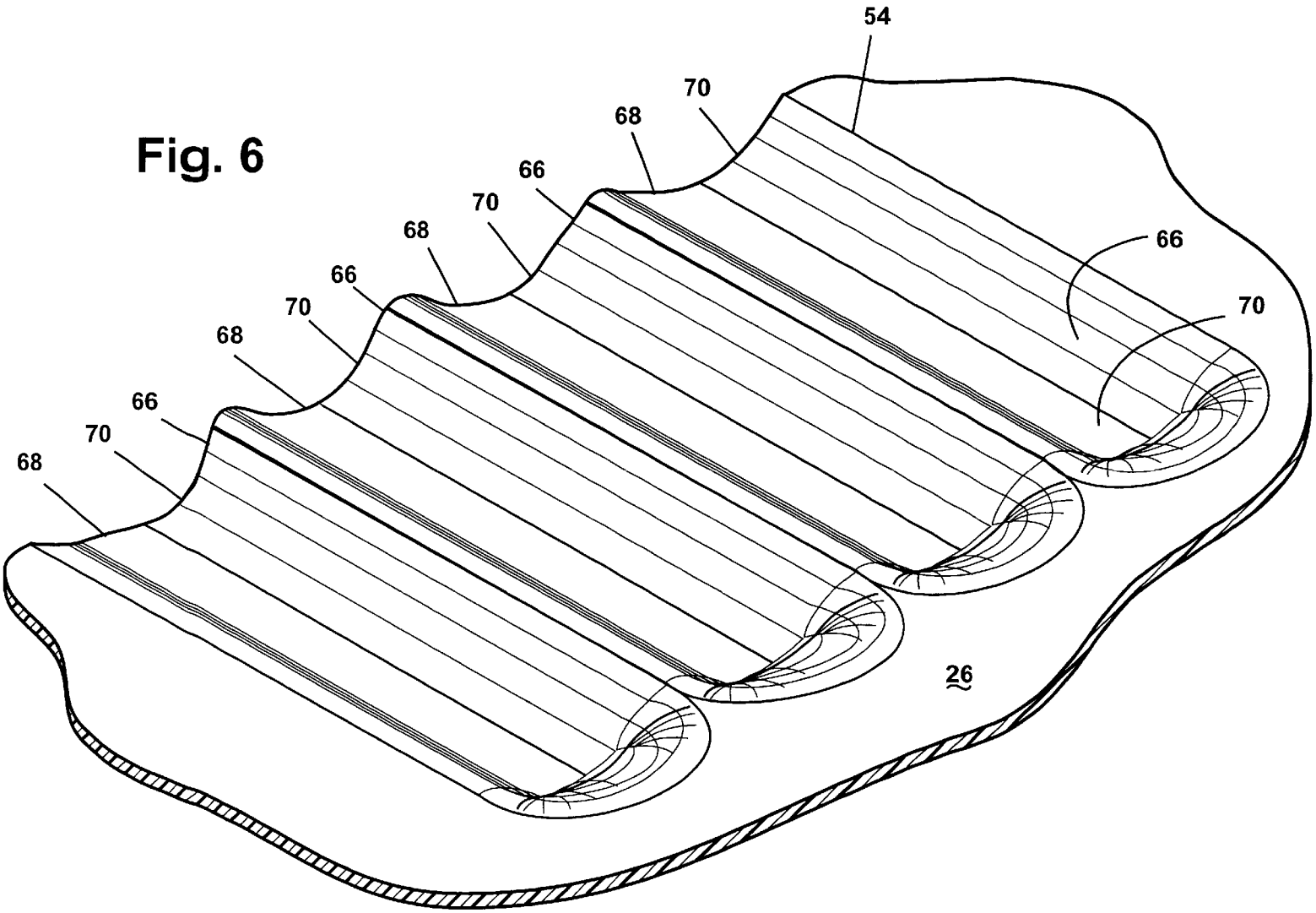
FIG. 6 is a enlarged partial perspective view of the corrugations in the bottom wall of the waster container.
Figure 7:
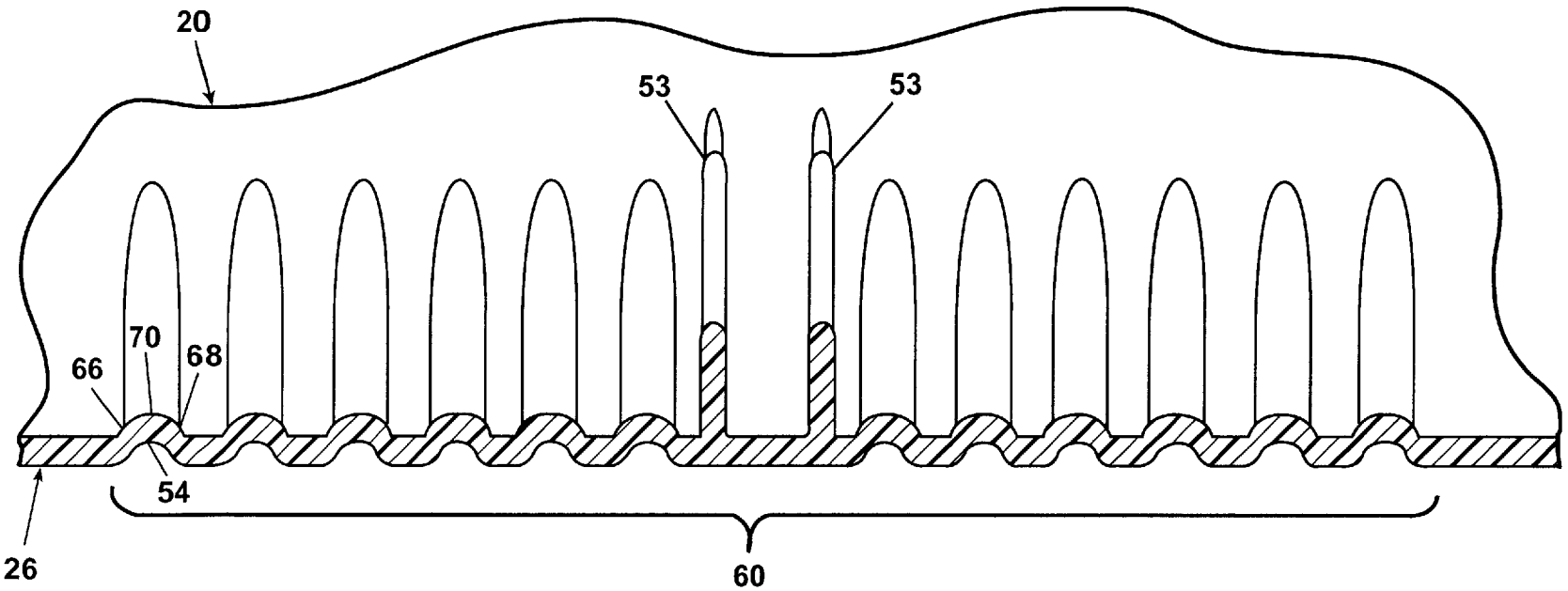
FIG. 7 is a sectional view taken along line 6—6 of FIG. 5 and illustrating the cross-sectional shape of the corrugations.

As best seen in FIGS. 6 and 7, all of the corrugations are elongated indentations with a generally inverted U-shape profile comprising side walls 66, 68 connected by a bottom wall 70. The corrugations extend upwardly into the waste compartment 28. The side walls 66, 68 are preferably canted outwardly away from the bottom wall 70, which is preferably arcuate, to form a continuous arc with the bottom wall 70. A flat portion of the bottom wall connects the adjacent indentations, resulting in a group of the corrugations having a wave-like cross section in the form of a truncated sinusoidal-like wave form. The corrugations of the preferred embodiment also have a substantially constant thickness, which is also preferably equal to the bottom wall thickness.

The corrugations can take a number of different cross-sectional shapes, including triangular and rectangular cross sections. Also, the thickness of the corrugations can vary relative to the thickness of the bottom wall. Preferably, the corrugations have a relatively thin cross section since the thicker the material, the greater the cooling time and the greater the likelihood that stresses will build up in the bottom wall.

The U-shaped cross section of the corrugations 54 increases the surface area of the bottom wall 26. The surface area of the waste container bottom illustrated in FIGS. 1–7 is up to two times greater than the surface area without the corrugations 54. The corrugations 54 also provide extra rigidity to the bottom wall 26 because of their cross-sectional shape which resists bending better than a planar bottom wall. Also, since the corrugations in general extend from the outer wear rib 50 to the inner wear rib 52, the combination of the wear ribs (which also provide a strengthening function) with the intersecting corrugations 54 provides an interlocking web of strengthening elements that greatly increase the overall rigidity of the bottom wall.

Functionally, the rear wall corrugations 60 provide a fluid channel from the rear wall to the bottom wall since the corrugations 60 extend around the intersection of the rear wall and bottom wall. The fluid channel formed by the rear wall corrugations help eliminate the likelihood of a vacuum forming between the bottom wall and the mold during removal of the container body from the mold during the injection molding process.

The corrugations 54 provide multiple advantages over the prior art. In addition to the increased rigidity of the bottom wall, the corrugations also provide an increased bottom wall surface area that provides for faster cooling of the bottom wall during the molding process making it more uniform with the cooling rate of the material in the rest of the cart. Another advantage of the corrugations is that they provide airflow channels for the flow of air between the mold and the bottom wall during the molding process to improve the ease of removal of the waste container body 12 from the mold. The combination of the increased rigidity and the airflow channels make it less likely that the bottom wall 26 of the container body 12 stretch or deform when air is injected between the bottom wall 26 and the mold during removal of the container body 12 from the mold, which reduces the likelihood of the bottom wall sagging during operation which can cause the premature failure of the waste container. The increased cooling rate attributable to the increased surface area also reduces the likelihood of molded-in stresses.

Reasonable variation and modification are possible within the scope of the foregoing disclosure without departing from the spirit of the invention which is defined by the appended claims.

What is claimed is:

1. A waste container for the storage and collection of residential or commercial waste, the waste container comprising:

a body having a bottom wall with a peripheral edge and a peripheral wall extending upwardly from the bottom wall peripheral edge and terminating in an upper edge to define an waste compartment with an open top;

a cover pivotally mounted to the body and moveable between an open position, in which the cover is remote of the open top to permit access to the waste receptacle, and a closed position, in which the cover overlies the open top to cover the same;

a handle extending from the body near the upper edge of the body;

a wheel assembly provided on the body near the bottom wall whereby a user can move the waste container by pulling or pushing on the handle to roll the waste container by the wheel assembly;

an inner rib projecting downwardly from a bottom surface of the bottom wall; and a plurality of corrugations formed in the bottom wall and extending from the bottom wall peripheral edge to the inner rib wherein the corrugations and inner rib cooperate to form a structural support for the bottom wall.

2. The waste container according to claim 1 wherein the corrugations comprise elongated indentations.

3. The waste container according to claim 2 wherein the thickness of the corrugations is substantially the same thickness of the bottom wall.

4. The waste container according to claim 3 wherein the bottom wall has a substantially constant thickness.

5. The waste container according to claim 2 wherein each of the elongated indentations define a longitudinal axis and have a U-shaped cross section transverse to the longitudinal axis.

6. The waste container according to claim 5 wherein the elongated indentations are arranged in groups of adjacent elongated indentations and the U-shaped combined cross sections of the group of elongated indentations forms a truncated sinusoidal-like wave form.

7. The waste container according to claim 6 wherein the inner rib circumscribes an interior portion of the lower surface of the bottom wall.

8. The waste container according to claim 7 wherein the bottom wall peripheral edge is substantially rectangular to define a front edge, a rear edge, and side edges connecting the front and rear edges, with corners formed at the junctions of the front and rear edges with the side edges, and further comprising corner indentations having an elongated arcuate profile positioned in the bottom wall near the corners and extending between adjacent groups of elongated indentations.

9. The waste container according to claim 8, and further comprising an outer peripheral rib projecting downwardly from the peripheral edge of the bottom wall along at least a portion of the bottom wall peripheral edge and at least some of the groups of elongated indentations extending between the outer rib and the inner rib.

10. The waste container according to claim 9 wherein at least some of the elongated indentations extend past the rear edge of the bottom wall and at least partially up the peripheral wall.

11. The waste container according to claim 2 wherein the inner rib circumscribes an interior portion of the bottom surface of the bottom wall.

12. The waste container according, to claim 11 wherein at least some of the elongated indentations extend beyond the peripheral edge of the bottom wall and at least partially up the peripheral wall.

13. The waste container according to claim 11 and further comprising an outer rib projecting downwardly from at least a portion of the peripheral edge of the bottom wall and the elongated indentations extend from the outer rib to the inner rib.

14. The waste container according to claim 13 wherein the elongated indentations each define a longitudinal axis and have a U-shaped cross section transverse to the longitudinal axis.

15. The waste container according to claim 14 wherein the thickness of the indentations is substantially constant.

16. The waste container according to claim 14 wherein the elongated indentations are arranged in groups of adjacent elongated indentations and the transverse cross section of the group of elongated indentations forms a truncated sinusoidal-like wave form.

17. The waste container according to claim 16 wherein the wheel assembly further comprises an axle mounted to the body and a pair of wheels mounted to the axle, with at least the axle being rotatable relative to the body or the wheels being rotatable relative to the axle.

18. A waste container for the storage of waste comprising:

a body having a bottom wall with a peripheral edge and a peripheral wall extending upwardly from the bottom wall peripheral edge and terminating in an upper edge to define a waste compartment with an open top;

an inner rib projecting downwardly from a bottom surface of the bottom wall inwardly of the bottom wall peripheral edge; and a plurality of corrugations formed in the bottom wall and extending from the bottom wall peripheral edge to the inner rib wherein the corrugations and inner rib cooperate to form a structural support for the bottom wall, with the portion of the bottom wall interior of the inner rib being substantially free of corrugations.

19. The waste container according to claim 18 wherein the inner rib circumscribes an interior portion of the bottom surface of the bottom wall.

20. The waste container according to claim 19 and further comprising an outer rib projecting downwardly from at least a portion of the peripheral edge of the bottom wall and the corrugations extend from the outer rib to the inner rib.

21. The waste container according to claim 20 wherein the corrugations have a substantially constant thickness.

22. The waste container according to claim 20 wherein the corrugations comprise elongated indentations.

23. The waste container according to claim 18 where in at least some of the elongated indentations extend beyond the peripheral edge of the bottom wall and at least partially up the peripheral wall.

24. The waste container according to claim 21 wherein the corrugations comprise elongated indentations.

25. The waste container according to claim 24 wherein at least some of the elongated indentations extend beyond the peripheral edge of the bottom wall and at least partially up the peripheral wall.

26. The waste container according to claim 25 wherein each elongated indentation defines a longitudinal axis and a U-shaped cross section transverse to the longitudinal axis.

27. The waste container according to claim 26 wherein the corrugated indentations are arranged in groups of adjacent elongated indentations wherein the transverse cross section of the group of elongated indentations forms a truncated sinusoidal-like wave form.

28. The waste container according to claim 27 and further comprising a wheel assembly comprising an axle mounted to the body and a pair of wheels mounted to the axle, with at least the axle being rotatable relative to the body or the wheels being rotatable relative to the axle.

* * * * *

UNITED STATES PATENT AND TRADEMARK OFFICE

CERTIFICATE OF CORRECTION

PATENT NO. : 6,276,557 B1
DATED : August 21, 2001
INVENTOR(S) : Wysocki

It is certified that error appears in the above-identified patent and that said Letters Patent is hereby corrected as shown below:

Column 5, claim 12,
Line 50, "according," should read -- according --

Column 6, claim 23,
Line 38, "where in" should read -- wherein --

Column 6, claim 27,
Line 52, "corrugated" should read -- elongated --

Signed and Sealed this

Nineteenth Day of March, 2002

*Attest:*

*Attesting Officer*

JAMES E. ROGAN
*Director of the United States Patent and Trademark Office*